US010443460B2

(12) United States Patent
Sprickmann Kerkerinck et al.

(10) Patent No.: US 10,443,460 B2
(45) Date of Patent: Oct. 15, 2019

(54) DEVICE AND METHOD FOR VENTING A CRANK CASING OF AN INTERNAL COMBUSTION ENGINE

(71) Applicants: MAN TRUCK & BUS AG, München (DE); HENGST SE, Münster (DE)

(72) Inventors: Stefan Sprickmann Kerkerinck, Nürnberg (DE); Heinz Herdering, Vreden (DE)

(73) Assignees: MAN Truck & Bus AG, Munich (DE); Hengst SE, Munich (DE)

( * ) Notice: Subject to any disclaimer, the term of this patent is extended or adjusted under 35 U.S.C. 154(b) by 0 days.

(21) Appl. No.: 16/072,445

(22) PCT Filed: Jan. 18, 2017

(86) PCT No.: PCT/EP2017/000048
§ 371 (c)(1),
(2) Date: Jul. 24, 2018

(87) PCT Pub. No.: WO2017/129350
PCT Pub. Date: Aug. 3, 2017

(65) Prior Publication Data

US 2019/0032528 A1 Jan. 31, 2019

(30) Foreign Application Priority Data

Jan. 25, 2016 (DE) ..... 10 2016 000 632

(51) Int. Cl.
*F01M 13/00* (2006.01)
*F01M 13/04* (2006.01)
*F01M 11/06* (2006.01)

(52) U.S. Cl.
CPC ..... *F01M 13/0011* (2013.01); *F01M 11/065* (2013.01); *F01M 13/04* (2013.01); *F01M 2013/0044* (2013.01)

(58) Field of Classification Search
CPC .. F01M 11/065; F01M 13/04; F01M 13/0011; F01M 2013/0044; F02M 35/10222; F02D 2250/08
See application file for complete search history.

(56) References Cited

U.S. PATENT DOCUMENTS 7,523,748 B2 * 4/2009 Hirano ..... F01M 13/02 123/572
9,027,536 B2 * 5/2015 Pursifull ..... F02M 35/10222 123/572

FOREIGN PATENT DOCUMENTS

DE 196 15 870 10/1997
DE 197 15 233 11/1998
(Continued)

*Primary Examiner* — Grant Moubry
(74) *Attorney, Agent, or Firm* — Cozen O'Connor

(57) ABSTRACT

The invention relates to a device for venting a crank casing of an internal combustion engine for a vehicle, having a plurality of venting ducts (13, 15, 53, 67, 84) by means of which gases flowing into a crank casing space (19) of the crank casing (7) can be conducted out of the crank casing space (19) again, wherein gas inlet openings (29, 55, 73), opening into the crank casing space (19), of the venting ducts are arranged in such a way that in a first defined inclination position of the internal combustion engine (3) a first venting duct does not dip with its gas inlet opening (29) into oil trough oil which is collected in an oil trough (5) of the internal combustion engine (3), and a second venting duct dips with its gas inlet opening (29, 55, 73) into the oil trough oil, wherein in a second defined inclination position of the internal combustion engine (3) which differs from the first inclination position the first venting duct (13, 67) dips with its gas inlet opening (29) into the oil trough oil and the second venting duct does not dip with its gas inlet opening (29, 55, 73) into the oil trough oil. According to the invention, a control device is provided by means of which a
(Continued)

flow of fluid through the venting ducts can be shut off and released fluidically as a function of the inclination of the internal combustion engine (3), wherein in the first inclination position of the internal combustion engine (3) the control device releases the first venting duct and shuts off the second venting duct, and wherein in the second inclination position of the internal combustion engine (3) the control device releases the second venting duct and shuts off the first venting duct.

12 Claims, 10 Drawing Sheets

(56) References Cited

FOREIGN PATENT DOCUMENTS

| | | |
|---|---|---|
| DE | 101 29 362 | 1/2003 |
| DE | 102 38 422 | 3/2004 |
| EP | 1 394 372 | 3/2004 |
| JP | S58 156111 | 10/1983 |
| JP | S59 40512 | 3/1984 |
| JP | H09 88542 | 3/1997 |

* cited by examiner

DEVICE AND METHOD FOR VENTING A CRANK CASING OF AN INTERNAL COMBUSTION ENGINE

CROSS-REFERENCE TO RELATED APPLICATIONS

This is a U.S. national stage of application No. PCT/EP2017/000048 filed 18 Jan. 2017. Priority is claimed on European Application No. 10 2016 000 632.3 filed 25 Jan. 2016, the content of which is incorporated herein by reference in its entirety.

BACKGROUND OF THE INVENTION

1. Field of the Invention

The invention relates to an apparatus for ventilating a crankcase of an internal combustion engine, to a method for ventilating a crankcase of an internal combustion engine, and to a vehicle, in particular utility vehicle, having the apparatus and/or for carrying out the method.

2. Description of the Related Art

It is known to provide, on an internal combustion engine, a crankcase ventilation device by which gases that flow into a crank chamber of the internal combustion engine during the operation of the internal combustion engine, in particular blow-by gases, are conducted out of the crank chamber again and introduced into an intake tract of the internal combustion engine. This counteracts, for example, corrosion of a crankcase of the internal combustion engine and a contamination of the oil sump oil, which has collected in an oil sump of the internal combustion engine, by the gases flowing into the crank chamber. Here, the gases are conventionally conveyed out of the crank chamber by the negative pressure prevailing in the intake tract.

It is furthermore also known for a crankcase ventilation device to be formed with multiple ventilation channels, wherein gas inlet openings, which open into the crank chamber of the internal combustion engine, of the multiple ventilation channels are arranged such that it is always the case, regardless of the inclination or orientation of the internal combustion engine, that at least one ventilation channel does not dip with its gas inlet opening into the oil sump oil. It is thereby ensured that the crank chamber or the crankcase chamber is ventilated even in the case of extreme lateral inclinations, or during uphill and downhill travel, of a vehicle that has the internal combustion engine.

For example, DE 102 38 422 A1 has disclosed a crankcase ventilation device in the case of which, at a clutch side, facing toward a vehicle transmission, of a crankcase, and at an end side of the crankcase situated opposite the clutch side, there is arranged in each case one ventilation line which projects into a crank chamber of the crankcase and which serves for ventilating the crankcase. By this arrangement of the ventilation lines, it is ensured that, when a vehicle that has the internal combustion engine is traveling uphill or downhill, at least one ventilation line is always situated with its gas inlet opening above the oil level of the oil that has collected in an oil sump of the internal combustion engine. It is thereby achieved that the crankcase is reliably ventilated even during uphill and downhill travel.

In the case of such a ventilation arrangement, however, problems arise if a ventilation line dips with its gas inlet opening into the oil sump oil and then a large quantity of oil sump oil is conveyed via the ventilation line into the intake tract of the internal combustion engine. In the worst case, this can lead to severe engine damage.

SUMMARY OF THE INVENTION

It is therefore an object of one aspect of the invention to provide a device and a method for ventilating a crankcase of an internal combustion engine for a vehicle, in particular for a utility vehicle, by which the functioning of the crankcase ventilation device is reliably ensured and, at the same time, an introduction of oil into the intake tract of the internal combustion engine is prevented.

An apparatus for ventilating a crankcase of an internal combustion engine for a vehicle, in particular for a utility vehicle, having multiple ventilation channels by which gases flowing into a crankcase chamber of the crankcase are conducted out of the crankcase chamber again, preferably are conducted from the crankcase chamber into an intake tract of the internal combustion engine, wherein gas inlet openings, which open into the crankcase chamber, of the multiple ventilation channels are arranged such that, in a first inclination position of the internal combustion engine, a first ventilation channel does not dip with its gas inlet opening into oil sump oil that has collected in an oil sump of the internal combustion engine and a second ventilation channel dips with its gas inlet opening into the oil sump oil, wherein, in a second defined inclination position, which differs from the first inclination position, of the internal combustion engine, the first ventilation channel dips with its gas inlet opening into the oil sump oil and the second ventilation channel does not dip with its gas inlet opening into the oil sump oil. According to the invention, a control device is provided by which, in particular in order to prevent an introduction of oil sump oil into the intake tract, a fluid flow through the ventilation channels can be shut off and enabled in terms of flow, in particular automatically, in a manner dependent on the inclination of the internal combustion engine, wherein, in the first inclination position of the internal combustion engine, the control device opens up the first ventilation channel and shuts off the second ventilation channel, and wherein, in the second inclination position of the internal combustion engine, the control device opens up the second ventilation channel and shuts off the first ventilation channel.

In this way, the functioning of the crankcase ventilation device is reliably ensured, because, both in the first inclination position and in the second inclination position of the internal combustion engine, it is always the case that one ventilation channel does not dip with its gas inlet opening into the oil sump oil, and the fluid flow through the ventilation channel that does not dip into the oil sump oil is enabled by the control device. At the same time, the apparatus according to one aspect of the invention also prevents an introduction of relatively large oil quantities into the intake tract of the internal combustion engine, because, both in the first inclination position and in the second inclination position of the internal combustion engine, the fluid flow through the ventilation channel that dips into the oil sump oil is shut off by the control device.

Here, the expression "inclination position" is expressly to be understood in a broad sense. Accordingly, the first or the second inclination position of the internal combustion engine may be formed for example by a basic position of the internal combustion engine in which the internal combustion engine is situated when the vehicle that has the internal combustion engine is situated on a level or horizontal plane.

Likewise, the first or the second inclination position may however also be formed by a position of the internal combustion engine in which the internal combustion engine has been rotated or pivoted relative to said basic position. Here, it is essential that the internal combustion engine is inclined differently, or oriented differently, in the first inclination position than in the second inclination position.

Furthermore, the apparatus according to the invention is not restricted to a construction with two ventilation channels that open into the crank chamber. It is self-evidently also possible for more than two channels that open into the crank chamber to be provided for ventilating the crankcase.

Here, the gases that flow into the crankcase chamber are preferably conducted from the crankcase chamber into the intake tract of the internal combustion engine by the ventilation channels. It would however alternatively also be conceivable for the gases that flow into the crankcase chamber to be conducted by the ventilation channels directly into the atmosphere or into the surroundings of the apparatus, such that an "open" ventilation arrangement is realized.

In a preferred design embodiment of the apparatus according to one aspect of the invention, the gas inlet openings of the multiple ventilation channels are arranged such that, regardless of the inclination or orientation of the internal combustion engine, it is always the case that at least one ventilation channel does not dip into the oil sump oil. In this way, the functioning of the crankcase ventilation device is ensured in a particularly reliable manner.

It is furthermore preferable if, as viewed in a fluid flow direction, there is provided upstream of the intake tract at least one oil separator element by which oil can be separated off from the fluid flowing via the ventilation channels into the intake tract. An oil separator element of said type serves to prevent no oil from passing via the ventilation channels into the intake tract. Provision is preferably made here whereby, in the first inclination position of the internal combustion engine, the control device shuts off a fluid flow through the second ventilation channel to the at least one oil separator element, and in the second inclination position of the internal combustion engine, said control device shuts off a fluid flow through the first ventilation channel to the at least one oil separator element. This prevents such a large quantity of oil being supplied to the oil separator element that the latter is overloaded or cannot separate off the oil to a sufficient extent.

In a preferred specific design embodiment, the control device has a first shut-off valve for shutting off and opening up the first ventilation channel and a second shut-off valve for shutting off and opening up the second ventilation channel. Using such shut-off valves, the shutting-off and opening-up of the ventilation channels in accordance with the invention can be realized in a simple and functionally reliable manner. It is however self-evidently basically also possible for more than two shut-off valves to be provided for shutting off and opening up the ventilation channels.

The first and/or the second shut-off valve may basically be arranged for example downstream of the at least one oil separator element as viewed in a fluid flow direction. It is however preferable if, as viewed in a fluid flow direction, the first and/or the second shut-off valve is arranged upstream of the at least one oil separator element in order to counteract an overloading of the at least one oil separator element if the respective ventilation channel dips with its gas inlet opening into the oil sump oil.

Preferably, the first and/or the second shut-off valve are assigned to a cylinder head, in particular to a cylinder head cover, of the internal combustion engine, in order to realize a simple and low-maintenance construction. Alternatively and/or in addition, the first and/or the second shut-off valve may however also be assigned to the crankcase of the internal combustion engine in order to ensure that as small an oil quantity as possible flows into the respective ventilation channel if the latter dips into the oil sump oil. This has the advantage inter alia that the oil level in the oil sump is kept higher, and a situation in which an intake opening of an oil pump of the internal combustion engine lies above the oil level is counteracted.

It is furthermore preferable for the first shut-off valve to be arranged in a defined vicinity in the region of the gas inlet opening of the first ventilation channel. In this way, a flow of oil sump oil into the first ventilation channel is counteracted in an effective manner. Alternatively and/or in addition, the second shut-off valve may also be arranged in a defined vicinity in the region of the gas inlet opening of the second ventilation channel.

In a further preferred refinement, the first shut-off valve and at least one oil separator element form a structural unit or installation unit. In this way, the installation of the first shut-off valve and of the at least one oil separator element is considerably simplified. Alternatively and/or in addition, provision may however also be made for the second shut-off valve and at least one oil separator element to form a structural unit. Further alternatively and/or in addition, provision may also be made for the first shut-off valve, the second shut-off valve and at least one oil separator element to form a structural unit, in order to further simplify the installation process and realize a particularly compact construction. Here, the first and the second shut-off valve respectively may be arranged for example at an oil inlet region or at an oil outlet region of the structural unit.

The control device preferably has an inclination detection device by which the present inclination or orientation of the internal combustion engine can be detected, wherein the first and/or the second shut-off valve can be automatically activated or actuated by a control unit of the control device in a manner dependent on the detected present inclination of the internal combustion engine in order to shut off or open up the respective ventilation channel. In this way, a fluid flow through the ventilation channels can be reliably and easily shut off and enabled in terms of flow in a manner dependent on the present inclination of the internal combustion engine.

The inclination detection device is preferably formed by at least one oil quantity sensor by which the oil quantity flowing through the first and/or the second ventilation channel can be measured. By an oil level sensor of said type, the present inclination of the internal combustion engine can be estimated with sufficient accuracy, because, in the situation in which a ventilation channel dips into the oil sump oil, a considerably greater oil quantity is conveyed through the respective ventilation channel than in the situation in which the respective ventilation channel does not dip into the oil sump oil. Furthermore, by an oil quantity sensor of said type, it is possible to detect whether an excessively large oil quantity flows through the respective ventilation channel even independently of whether or not the respective ventilation channel dips into the oil sump oil. Thus, by the oil quantity sensor, the introduction of an excessively large oil quantity into the intake tract is prevented in a particularly reliable manner. The oil quantity flowing through the ventilation channel may in this case be determined for example by the density of the fluid flowing through the ventilation channel or by the oil fraction in the fluid flowing through the ventilation channel.

Alternatively and/or in addition to the oil quantity sensor, the inclination detection device may also be formed by an oil level sensor, by which the level of the oil sump oil that has collected in the oil sump can be measured. The present inclination or orientation of the internal combustion engine can likewise be reliably estimated by the level of the oil sump oil that has collected in the oil sump. Further alternatively and/or in addition, the inclination detection device may also be formed by an inclination sensor, by which the inclination or the orientation of the internal combustion engine can be measured. An inclination sensor of said type may be formed for example by an acceleration sensor.

Alternatively and/or in addition to the activation of the first and/or of the second shut-off valve by the control unit, the first and/or second shut-off valve may also be formed by a float valve, in order for the first and/or second shut-off valve to be designed to be particularly fast-reacting. Provision is preferably made here for a float body of the float valve to be formed as a sealing element, which can be pressed against a corresponding sealing seat in order to shut off the fluid flow through the respective ventilation channel and which opens up a defined flow cross section in order to enable the fluid flow through the respective ventilation channel. The float valve can thus be realized in a simple and functionally reliable form.

The float valve preferably has at least one loading element, in particular a spring element, which preloads the float body arranged in its closed position into its open position. By a loading element of said type, it is reliably ensured that the float valve always opens and closes as desired. In particular, by the loading element, it is possible to prevent the float valve from closing already in the presence of relatively high gas throughputs. The float valve is further preferably arranged in a U limb of a substantially U-shaped ventilation channel section, the U base of which has at least one base-wall-side oil outflow opening for the discharge of oil that has collected in the U base and/or in the U limbs. In this way, a simple and functionally reliable construction is realized. Furthermore, the labyrinthine, U-shaped ventilation channel section acts as a coarse separator for the oil flowing through the ventilation channel.

Alternatively and/or in addition to the embodiment as a float valve, the first and/or the second shut-off valve may also have a sealing body with a defined flow contour, which is pressed against a corresponding sealing seat, in order to shut off the fluid flow through the respective ventilation channel, by the fluid flow and which opens up a defined flow cross section in order to enable the fluid flow through the respective ventilation channel. Accordingly, the first and/or the second shut-off valve can likewise be designed to be particularly fast-reacting and reliable. The sealing body may in this case for example be pressed against the corresponding sealing seat by the fluid flowing through the ventilation channel if the oil quantity flowing through the ventilation channel exceeds a defined oil quantity threshold value. If the oil quantity flowing through the ventilation channel falls below the defined oil quantity threshold value again, the sealing element may then open up a defined flow cross section again. The opening-up and shutting-off of the ventilation channel is in this case thus dependent on the impetus or the dynamic pressure exerted on the sealing body by the fluid flow. This pressure increases with increasing flow speed and increasing density of the fluid flow. The oil quantity threshold value is in this case preferably formed by a defined gas-oil ratio. Provision is preferably furthermore made for the sealing element to be of spherical and/or plate-shaped form and/or to have a defined flow resistance value or $c_w$ value.

Further preferably, at least one loading element, in particular a spring element, is provided, which preloads the sealing body arranged in its closed position into its open position in order to be able at all times to open up and shut off the respective ventilation channel as desired by the sealing body. It is furthermore preferable if, as viewed in a fluid flow direction, the sealing body is arranged directly upstream of at least one active or driveable oil separator element, in particular a centrifuge or a disk separator.

Alternatively and/or in addition to the sealing body, the first and/or the second shut-off valve may also have a shut-off element, which is fixed so as to be rotatable relative to the respective ventilation channel about an axis of rotation and which, in a first rotational position, opens up the respective ventilation channel and, in a second rotational position, shuts off the respective ventilation channel, wherein the shut-off element is connected by at least one lever element to a counterweight element that has a defined mass, in such a way that the shut-off element always has the same orientation relative to the horizontal regardless of the inclination of the internal combustion engine about an inclination axis running in a direction of the axis of rotation. By a shut-off valve designed in this way, the shutting-off and opening-up of the respective ventilation channel in accordance with the invention can be realized in a reliable and fast-reacting manner. Provision is preferably made here for the at least one shut-off valve to be formed by a throttle flap and/or by a rotary slide.

To achieve the object stated above, a method for ventilating a crankcase of an internal combustion engine for a vehicle, in particular for a utility vehicle, is furthermore claimed, having multiple ventilation channels by which gases flowing into a crankcase chamber of the crankcase are conducted out of the crankcase chamber again, preferably are conducted from the crankcase chamber into an intake tract of the internal combustion engine, wherein gas inlet openings, which open into the crankcase chamber, of the multiple ventilation channels are arranged such that, in a first defined inclination position of the internal combustion engine, a first ventilation channel does not dip with its gas inlet opening into oil sump oil that has collected in an oil sump of the internal combustion engine, wherein, in a second defined inclination position, which differs from the first inclination position, of the internal combustion engine, the first ventilation channel dips with its gas inlet opening into the oil sump oil and the second ventilation channel does not dip with its gas inlet opening into the oil sump oil. According to the invention, a control device is provided by which, in particular in order to prevent an introduction of oil sump oil into the intake tract, a fluid flow through the ventilation channels is shut off and enabled in terms of flow, in particular automatically, in a manner dependent on the inclination of the internal combustion engine, wherein, in the first inclination position of the internal combustion engine, the control device opens up the first ventilation channel and shuts off the second ventilation channel, and wherein, in the second inclination position of the internal combustion engine, the control device opens up the second ventilation channel and shuts off the first ventilation channel.

The advantages that arise from the method implementation according to the invention are identical to the already-discussed advantages of the apparatus according to the invention, and will not be repeated at this juncture.

Also claimed is a vehicle, in particular a utility vehicle, having the apparatus according to the invention and/or for carrying out the method according to the invention. The advantages that arise from this equate to the already-discussed advantages of the apparatus according to the invention and will likewise not be repeated here. Preferably, the vehicle is formed here by a vehicle which is subject to increased longitudinal and/or transverse acceleration, because it is here that the apparatus according to the invention and the method according to the invention are particularly effective. A vehicle of said type may be formed for example by an off-road vehicle or by a ship.

The advantageous embodiments and/or refinements of the invention discussed above and/or defined in the subclaims may—other than for example in the cases of unique dependencies or non-combinable alternatives—be used individually or else in any desired combination with one another.

BRIEF DESCRIPTION OF THE DRAWINGS

The invention and the advantageous embodiments and/or refinements thereof, and the advantages thereof, will be discussed in more detail below, merely by way of example, on the basis of drawings.

In the drawings.

DETAILED DESCRIPTION OF THE EXEMPLARY EMBODIMENTS

Figure 1:
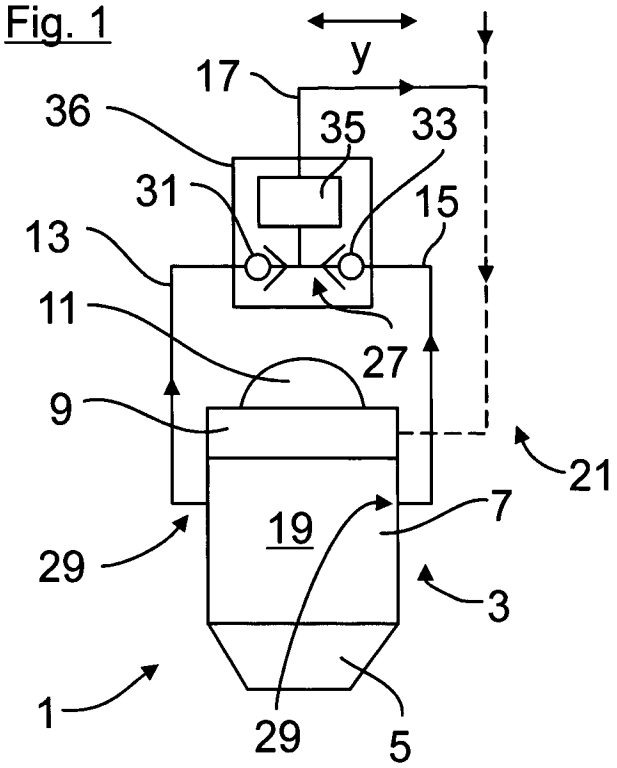
FIG. 1 is a schematic illustration depicting the construction of an apparatus according to the invention.

FIG. 1 shows a first embodiment of an apparatus 1 according to the invention. The apparatus 1 has an internal combustion engine 3, which is designed in this case for example as an in-line engine, and which comprises an oil sump 5, a crankcase 7, a cylinder head 9 and a cylinder head cover 11. The apparatus 1 furthermore has multiple, in this case for example three, ventilation channels or ventilation lines 13, 15, 17, by which gases flowing into a crank chamber 19 of the crankcase 7, in particular blow-by gases, can be conducted into an intake tract 21, indicated by dashed lines, of the internal combustion engine 3. As an alternative to the introduction into the intake tract 21, it is also possible for the gases flowing into the crank chamber 19 to be conducted directly into the atmosphere or into the surroundings of the internal combustion engine 3, if the gases, before being introduced into the atmosphere, are also purified or cleaned by a suitable cleaning device.

The ventilation channels 13, 15 are formed here for example by pipelines that are joined in each case by one end region to the crankcase 7 and by their other end region to a joining region 27 to the ventilation channel 17, which in this case is likewise formed as a pipeline. Gas inlet openings 29 of the ventilation channels 13, 15 are in this case arranged, as viewed in an internal combustion engine transverse direction y, opposite one another laterally at the outside on the crankcase 7. By this arrangement, it is achieved that, in the case of any regular inclination of the internal combustion engine 3 about a longitudinal axis formed by the internal combustion engine longitudinal direction x (FIG. 7), it is always the case that at least one gas inlet opening 29 does not dip into oil sump oil that has collected in the oil sump 5.

Furthermore, in this case, the gas inlet openings 29 of the ventilation channels 13, 15 are also arranged such that, in defined first inclination positions of the internal combustion engine, the ventilation channel 13 does not dip with its gas inlet opening 29 into the oil sump oil that has collected in the oil sump 5, and the ventilation channel 15 dips with its gas inlet opening 29 into the oil sump oil that has collected in the oil sump 5. In defined second inclination positions of the internal combustion engine 3, however, the ventilation channel 13 dips with its gas inlet opening 29 into the oil sump oil, whereas the ventilation channel 15 in this case then does not dip with its gas inlet opening 29 into the oil sump oil.

As can also be seen from FIG. 1, in this case, the ventilation channel 13 is assigned a shut-off valve 31 and the ventilation channel 15 is assigned a shut-off valve 33. By the shut-off valves 31, 33, a fluid flow through the respective ventilation channel 13, 15 can be shut off and enabled. Furthermore, in this case, the ventilation channel 17 is assigned an oil separator element 35, by which oil or engine oil can be separated off from the fluid flowing through the ventilation channel 17. The separated-off oil is then introduced into the oil sump 5 again. Furthermore, the shut-off valves 31, 33 and the oil separator element 35 in this case form a structural unit 36.

Here, the actuation of the shut-off valves 31, 33 is performed in a manner dependent on the inclination of the internal combustion engine 3. Specifically, in this case, in the abovementioned first inclination positions of the internal combustion engine 3, for example beyond an inclination of 20° of the internal combustion engine in a first direction about the longitudinal axis, the ventilation channel 13 is opened up by the shut-off valve 31 and the ventilation channel 15 is shut off by the shut-off valve 33. Furthermore, in the likewise abovementioned second inclination positions of the internal combustion engine 3, for example beyond an inclination of 20° of the internal combustion engine in a second direction, which is opposite to the first direction, about the longitudinal axis, the ventilation channel 15 is opened up by the shut-off valve 33 and the ventilation channel 13 is shut off by the shut-off valve 31. In this way, it is reliably ensured that the oil sump oil is not conducted or conveyed into the intake tract 21 of the internal combustion engine 3 via a ventilation channel 13, 15 that is dipping into the oil sump oil. Exemplary embodiments of the shut-off valves 31, 33 will be discussed in more detail further below. Further embodiments of the apparatus according to the invention will now be discussed in more detail below. The basic functioning of these apparatuses is however identical to the functioning of the first embodiment discussed above.

Figure 2:
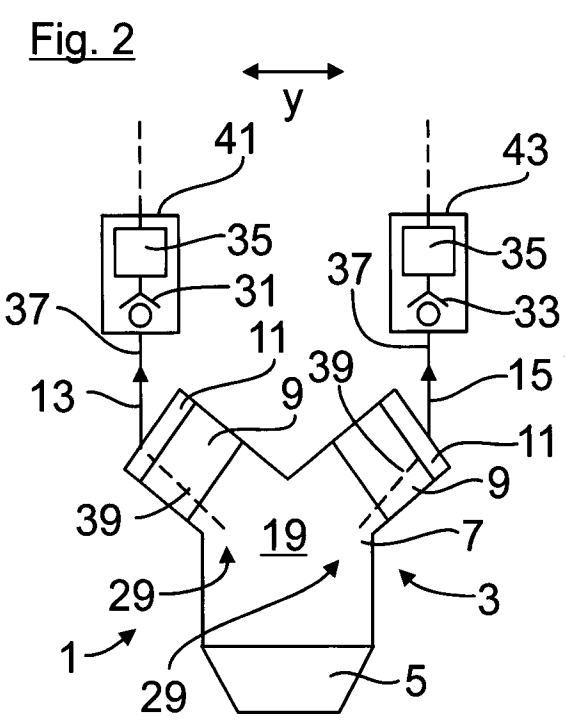
FIGS. 2 to 11 are illustrations as per FIG. 1, depicting the construction of the apparatus according to the invention.

FIG. 2 shows a second embodiment of the apparatus 1. In relation to the first embodiment shown in FIG. 1, the internal combustion engine 3 is formed in this case by a V engine. Thus, the internal combustion engine 3 in this case has two cylinder heads 9 and two cylinder head covers 11. Furthermore, the ventilation channels 13, 15 are formed here in each case by a channel section 37 running outside the internal combustion engine 3 and a channel section 39 indicated by dashed lines and running through the internal combustion engine 3. Here, the channel sections 37 may be formed for example by pipelines, which are connected to the cylinder head covers 11 of the internal combustion engine 3. The channel sections 39 are formed by recesses, which in this case run for example through the cylinder head covers 11 and the cylinder heads 9 to the crank chamber 19.

Furthermore, here, each ventilation channel 13, 15 is assigned an oil separator element 35, which is arranged downstream of the respective shut-off valve 31, 33 as viewed in a fluid flow direction and by which oil can be separated off from the fluid flowing through the respective ventilation channel 13, 15. The shut-off valve 31 and the oil separator element 35 of the ventilation channel 13 in this case furthermore form a structural unit 41. The shut-off valve 33 and the oil separator element 35 of the ventilation channel 15 also form a structural unit 43 here. It is furthermore also the case here that each ventilation channel 13, 15 opens into the intake tract 21 (not illustrated in FIG. 2) of the internal combustion engine 3.

Figure 3:
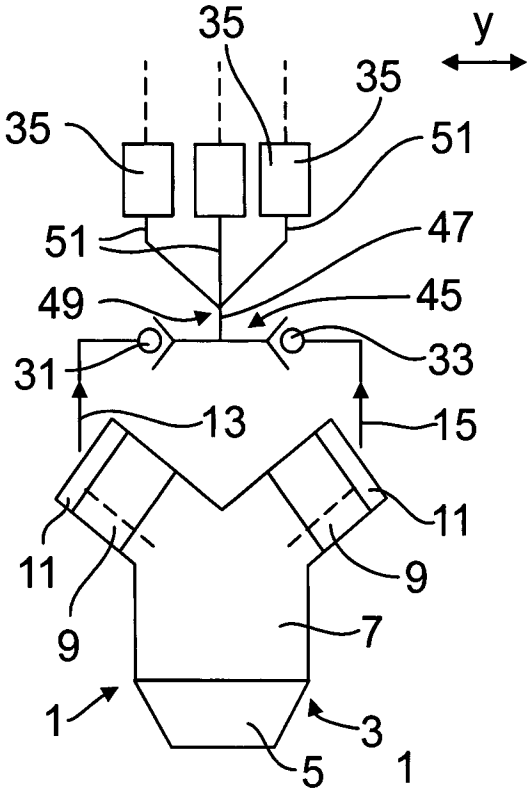

FIG. 3 shows a third embodiment of the apparatus 1. In relation to the second embodiment shown in FIG. 2, the ventilation channels 13, 15 are in this case joined, at a joining region 45, to form one ventilation channel or one ventilation line 47, which splits or branches again, at a branching region 49, into three ventilation channels or ventilation lines 51. Each ventilation channel 51 is in this case furthermore assigned an oil separator element 35 by which oil can be separated off from the fluid flowing through the respective ventilation channel 51. It is furthermore also the case here that each ventilation channel 51 opens into the intake tract 21 (not illustrated in FIG. 3) of the internal combustion engine 3.

Figure 4:
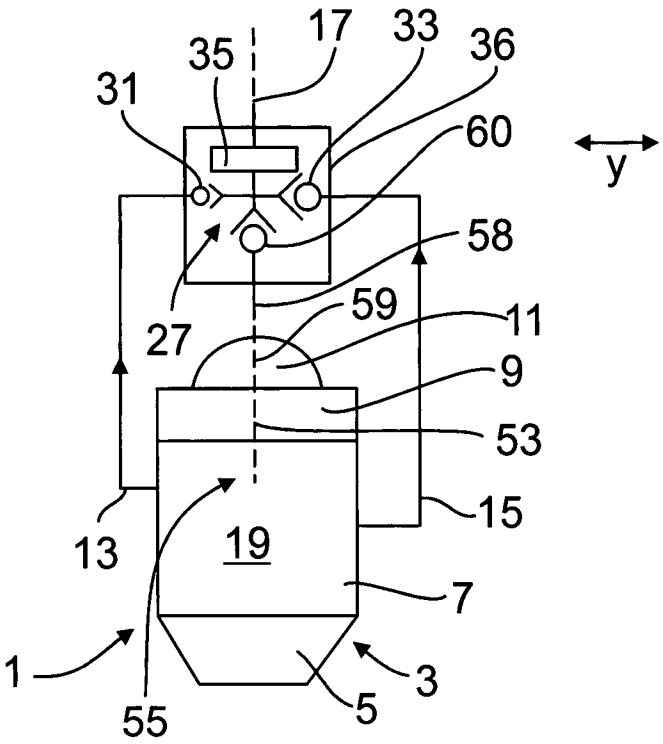

FIG. 4 shows a fourth embodiment of the apparatus 1. In relation to the first embodiment shown in FIG. 1, a ventilation channel 53 is additionally provided here, which opens with a gas inlet opening 55 into the crank chamber 19 of the crankcase 7 and joined at the joining region 27 to the ventilation channels 13, 15 to form the ventilation channel 17. The ventilation channel 53 is formed in this case by a channel section 58 running outside the internal combustion engine 3 and by a channel section 59 indicated by dashed lines and running through the internal combustion engine 3. Here, the channel section 59 is assigned a shut-off valve 60, by which a fluid flow through the ventilation line 53 can be shut off and enabled. The shut-off valve 60 is in this case furthermore a constituent part of the structural unit 36.

Figure 5:
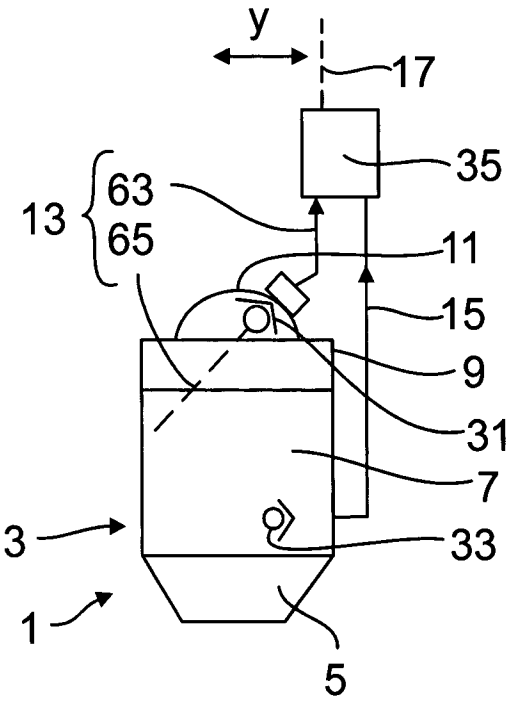

FIG. 5 shows a fifth embodiment of the apparatus 1. In relation to the first embodiment shown in FIG. 1, the oil separator element 35 and the shut-off valves 31, 33 in this case do not form a structural unit 36. The shut-off valve 33 is in this case furthermore assigned to the crankcase 7 of the internal combustion engine 3. The shut-off valve 31 is in this case assigned to the cylinder head cover 11 of the internal combustion engine 3. The ventilation channel 13 has in this case a channel section 63 running outside the internal combustion engine 3 and a channel section 65 indicated by dashed lines and running through the internal combustion engine 3. The channel section 63 is in this case formed by a pipeline which opens out at the cylinder head cover 11. The channel section 65 runs in this case through the cylinder head cover 11 and through the cylinder head 9 to the crank chamber 19. It is furthermore also the case here that both ventilation channels 13, 15 open out in the oil separator element 35 and are joined in the oil separator element 35 to form the ventilation channel 17.

Figure 6:
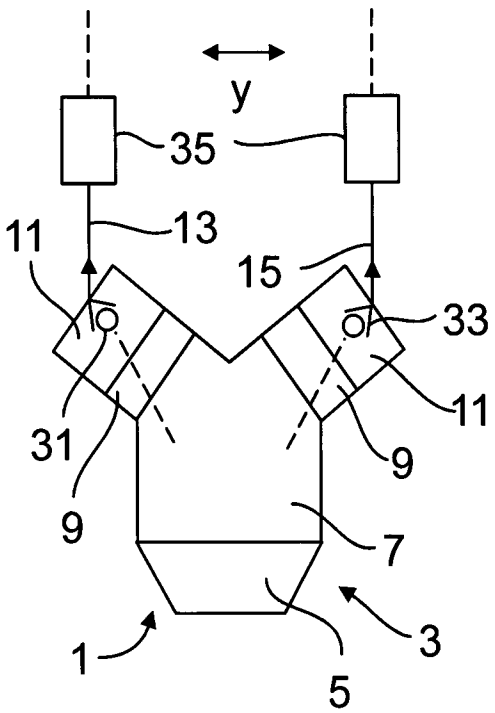

FIG. 6 shows a sixth embodiment of the apparatus 1. In relation to the second embodiment shown in FIG. 2, the shut-off valve 31 and the oil separator element 35 of the ventilation channel in this case do not form a structural unit. It is furthermore also the case here that the shut-off valve 33 and the oil separator element 35 of the ventilation channel 15 do not form a structural unit. Furthermore, here, the shut-off valves 31, 33 are assigned to the respective cylinder head cover 11.

Figure 7:
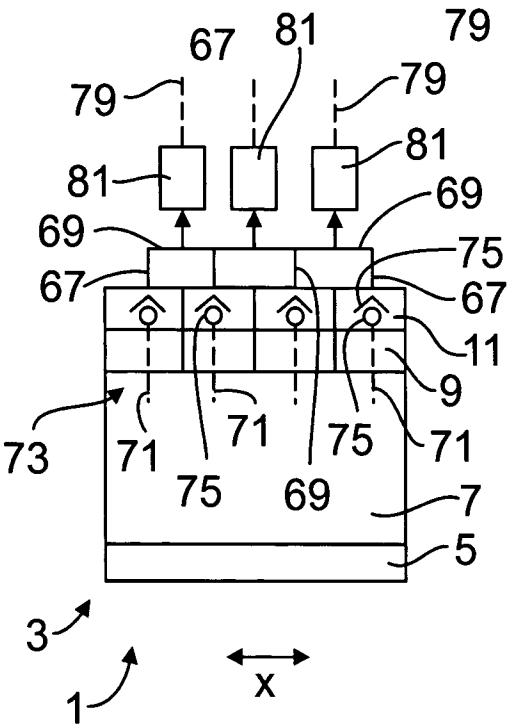

FIG. 7 shows a seventh embodiment of the apparatus 1. The internal combustion engine 3 is formed in this case as a four-cylinder in-line engine. The apparatus 1 has in this case multiple, in this case for example four, ventilation channels 67, which each have a channel section 69 arranged outside the internal combustion engine 3 and a channel section 71 running through the internal combustion engine 3. The channel section 69 is formed here by a pipeline that opens out at the cylinder head cover 11. Here, the channel section 71 runs through the cylinder head cover 11 and through the cylinder head 9 to the crank chamber 19.

Furthermore, gas inlet openings 73 of the ventilation channels 67 are in this case arranged so as to be distributed uniformly over the crank chamber 19 in an internal combustion engine longitudinal direction x. It is achieved in this way that, in any inclination of the internal combustion engine 3 about a transverse axis formed by the internal combustion engine transverse direction y (FIG. 1), at least one of the gas inlet openings 73 does not dip into the oil sump oil that has collected in the oil sump 5. Furthermore, it is also the case here that each ventilation channel 67 is assigned a shut-off valve 75 by which a fluid flow through the respective ventilation channel 67 can be shut off and enabled.

Here, it is furthermore the case that the four ventilation channels 67 are joined, at a joining region 77, to form three ventilation channels or ventilation lines 79. Here, each ventilation channel 79 is furthermore assigned an oil separator element 81 for separating off oil from the fluid flowing in the respective ventilation channel 79. It is furthermore the case here that the ventilation channels 79 open into the intake tract 21 (not illustrated in FIG. 7) of the internal combustion engine 3.

Figure 8:
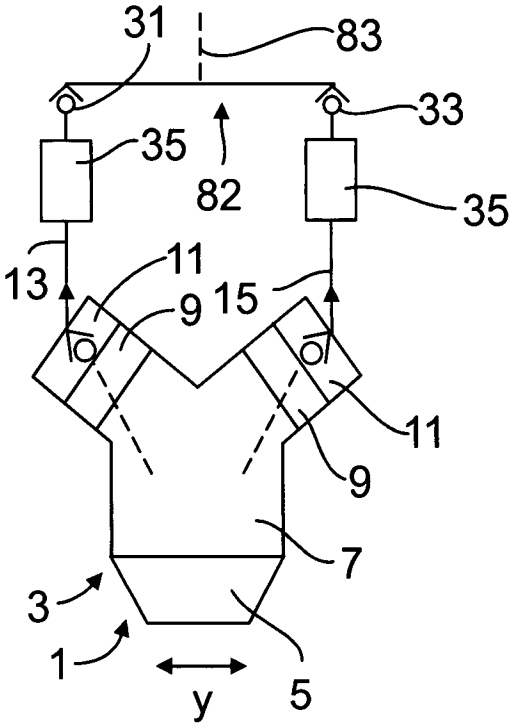

FIG. 8 shows an eighth embodiment of the apparatus 1. In relation to the sixth embodiment shown in FIG. 6, the shut-off valves 31, 33 are in this case not assigned to the cylinder head covers 11 of the internal combustion engine 3 but rather are arranged downstream of the oil separator element 35 of the respective ventilation channel 13, 15 as viewed in a fluid flow direction. It is furthermore the case here that the ventilation channels 13, 15 are joined, at a joining region 82 arranged downstream of the shut-off valves 31, 33, to form a ventilation channel 83, which opens into the intake tract 21 of the internal combustion engine 3.

Figure 9:
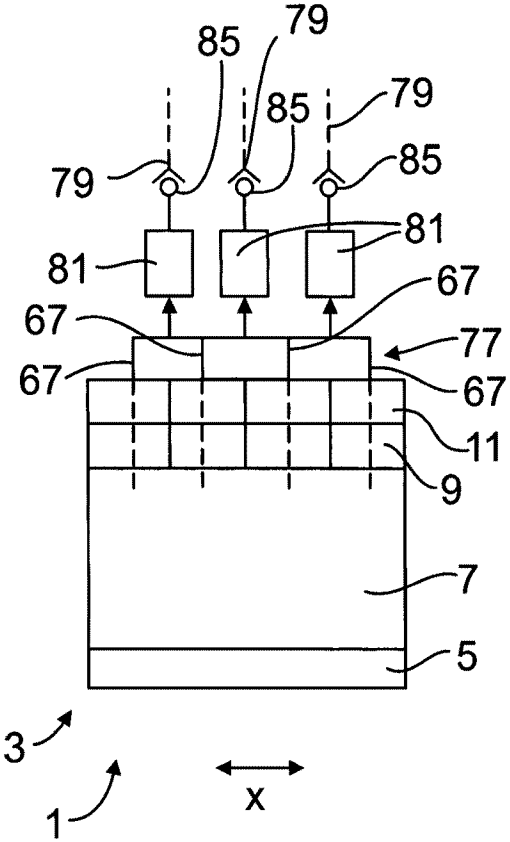

FIG. 9 shows a ninth embodiment of the apparatus 1. In relation to the seventh embodiment shown in FIG. 7, it is not the case here that four shut-off valves 75 are provided which are assigned to the cylinder head cover 11 of the internal combustion engine. In this case, instead, each ventilation channel 79 is assigned a shut-off valve 85.

Figure 10:
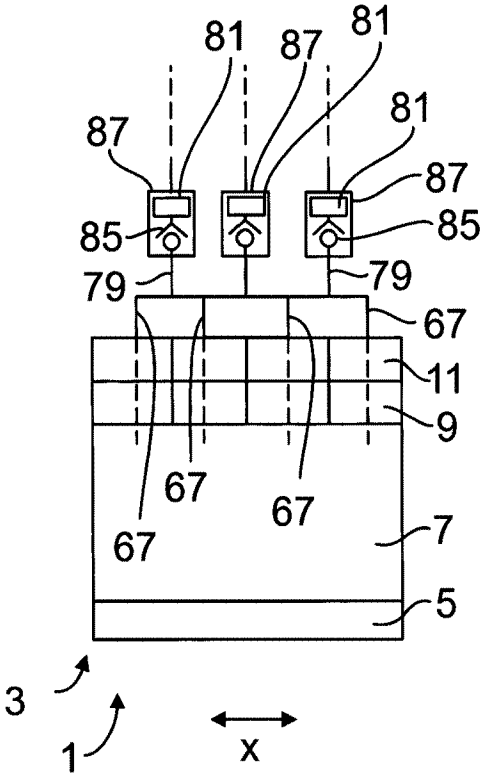

FIG. 10 shows a tenth embodiment of the apparatus 1. In relation to the ninth embodiment of the apparatus 1 shown in FIG. 9, the shut-off valve 85 and the oil separator element 81 of the respective ventilation channel 79 in this case form in each case one structural unit 87. It is furthermore the case here that the shut-off valves 85 are arranged upstream of the respective oil separator element 81 as viewed in a fluid flow direction.

Figure 11:
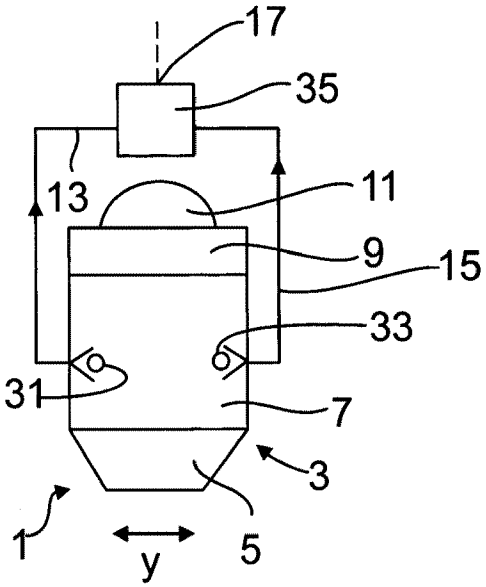

FIG. 11 shows an eleventh embodiment of the apparatus 1. In relation to the first embodiment of the apparatus 1 shown in FIG. 1, the shut-off valves 31, 33 and the oil separator element 35 in this case do not form a structural unit. Furthermore, the shut-off valves 31, 33 are in this case assigned to the crankcase 7 of the internal combustion engine 3.

Figure 12:
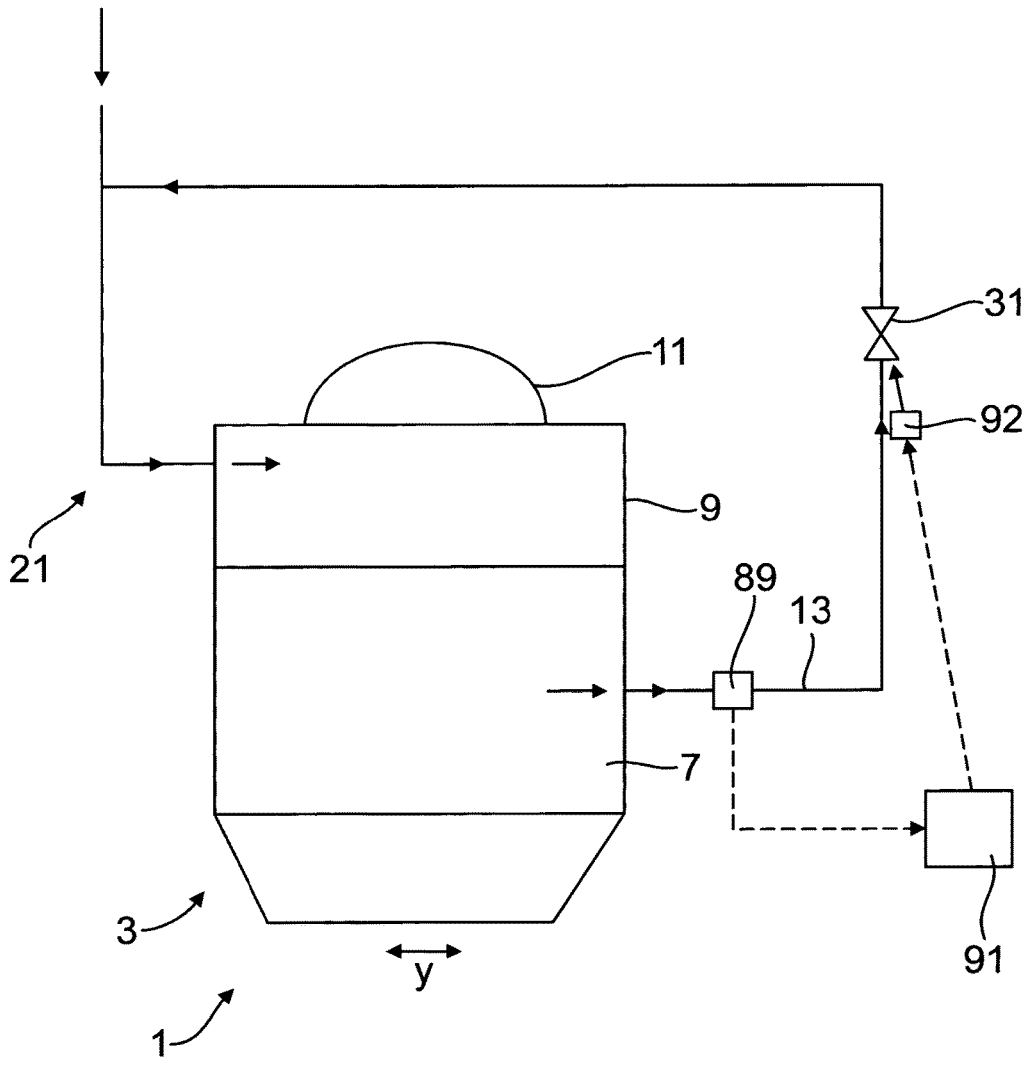
FIG. 12 is a circuit diagram depicting the construction of a control device of the apparatus.

FIG. 12 shows a first embodiment of the stated shut-off valves 31, 33, 75, 85, with the shut-off valve 31 being illustrated by way of example for this purpose.

As can be seen from FIG. 12, the ventilation channel 13 is in this case assigned an oil quantity sensor 89 by which the oil quantity flowing through the ventilation channel 13 can be measured. The oil quantity sensor 89 is in this case arranged upstream of the shut-off valve 31 as viewed in a fluid flow direction. Furthermore, the oil quantity sensor 89 is connected in terms of signal transmission to a control unit 91, by which the shut-off valve 31 or an actuating device 92 for actuating the shut-off valve 31 is activated, in order to shut off or open up the ventilation channel 13, in a manner dependent on the oil quantity detected by the oil quantity sensor 89. The shut-off valve 31 is in this case thus externally actuated.

Here, if the oil quantity measured by the oil quantity sensor 89 exceeds a defined oil quantity threshold value the shut-off valve 31 is activated by the control unit 91 such that the shut-off valve 31 shuts off the ventilation channel 13. If the oil quantity measured by the oil quantity sensor 89 falls below the defined oil quantity threshold value, the shut-off valve 31 is activated by the control unit 91 such that the shut-off valve 31 opens up the ventilation channel 13.

Figure 13:
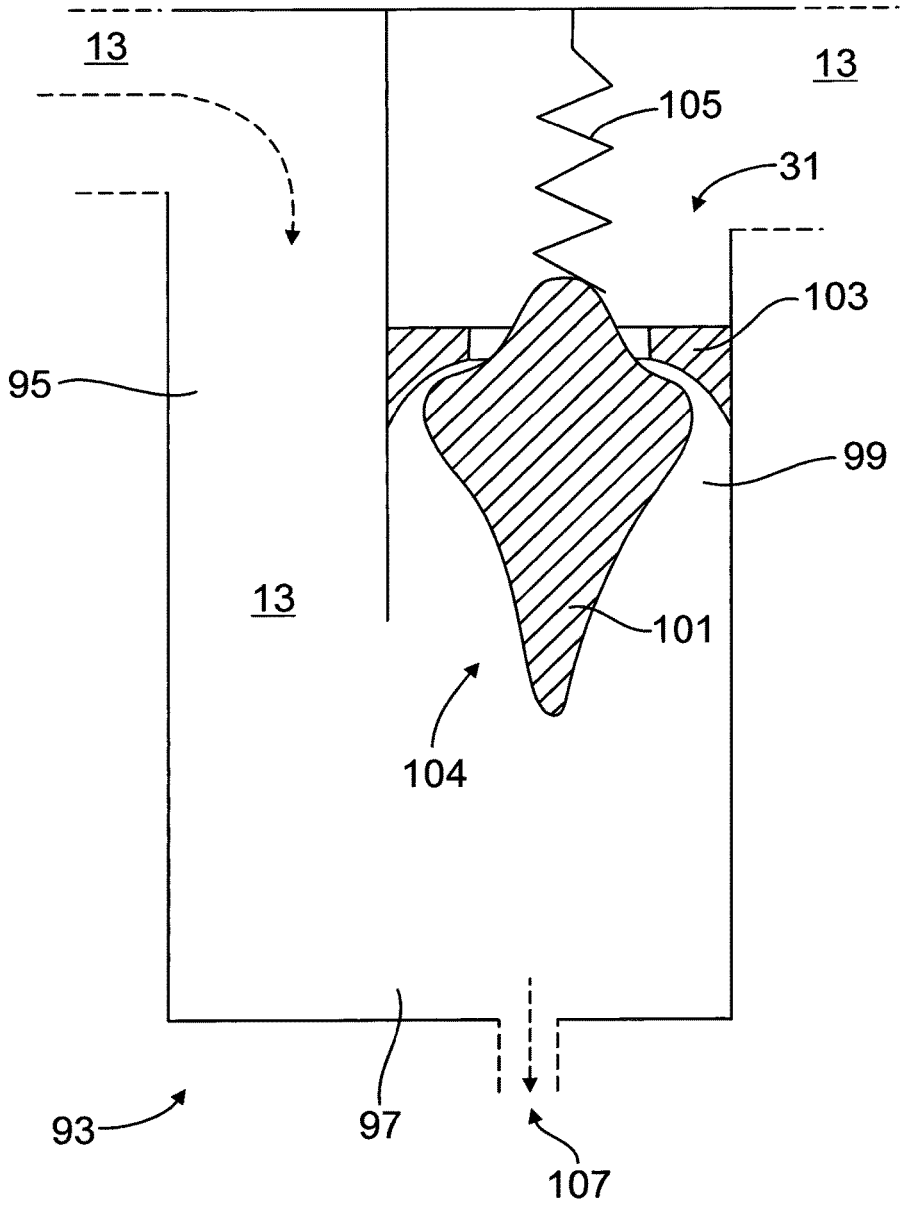
FIGS. 13 and 14 are a schematic illustrations depicting the of the control device.
Figure 14:
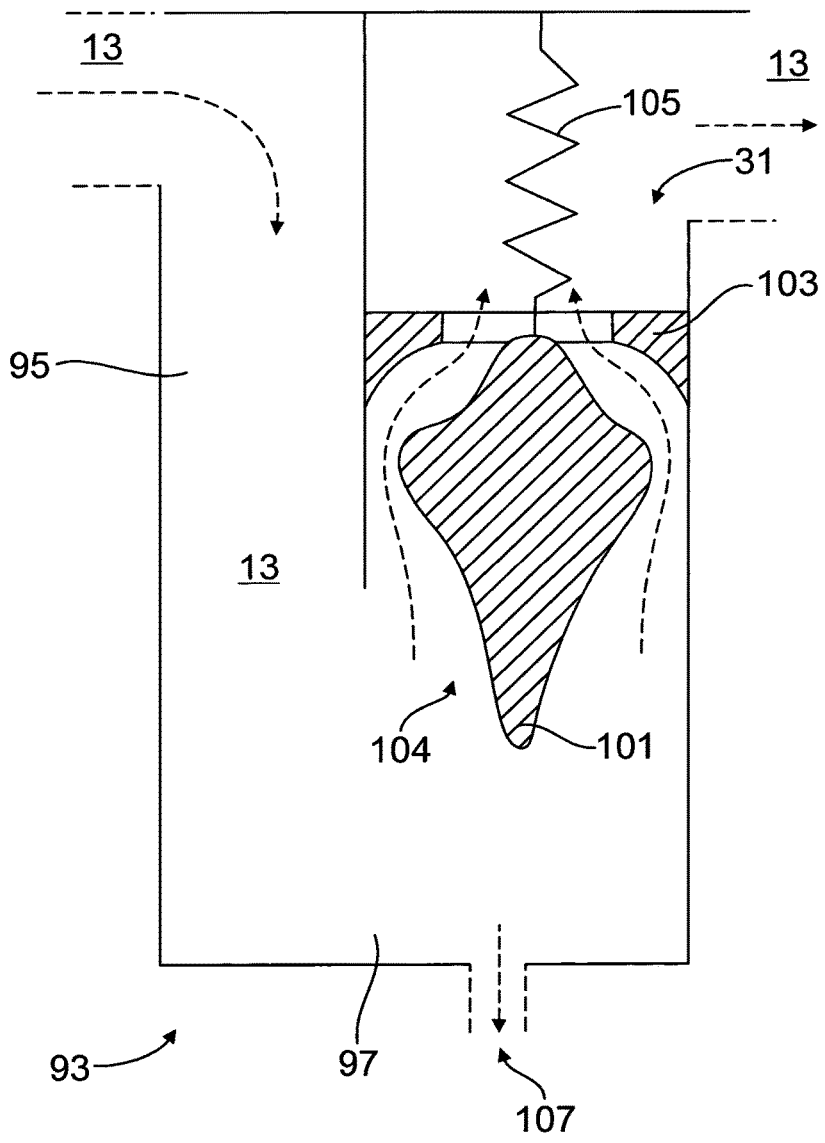

FIGS. 13 and 14 show a second embodiment of the shut-off valve 31. The shut-off valve 31 is formed in this case by a float valve arranged in a labyrinthine, U-shaped section 93 of the ventilation channel 13. The U-shaped section 93 has, as viewed in a fluid flow direction, a first U limb 95, a U base 97 and a second U limb 99. The shut-off valve 31 is in this case arranged for example in the second U limb 99 of the U-shaped section 93.

The shut-off valve 31 has in this case a float body 101 formed as a sealing element and which is pressed against a corresponding sealing seat 103 in order to shut off the fluid flow through the ventilation channel 13 and which opens up a defined flow cross section in order to enable the fluid flow through the ventilation channel 13. Here, FIG. 13 shows the float body 101 in its closed position, in which it shuts off the fluid flow through the ventilation channel 13. FIG. 14 shows the float body in its open position, in which the float body 101 enables the fluid flow through the ventilation channel 13.

Furthermore, the float body 101 in this case also has, by way of example, a flow-optimized region 104, the cross section of which in this case, by way of example, increases in a fluid flow direction. The flow-optimized region 104 is in this case formed such that the float body 101 is pressed against the sealing seat 103, in order to shut off the fluid flow through the ventilation channel 13, by the fluid flow and opens up a defined flow cross section in order to enable the fluid flow through the ventilation channel 13.

As can also be seen from FIGS. 13 and 14, the shut-off valve 31 in this case also has a spring element 105 which preloads the float body 101 arranged in its closed position into its open position. Furthermore, the U base 97 of the U-shaped section 93 also has in this case for example a base-wall-side oil outflow opening 107 for discharging oil that has collected in the U base 97 and in the U limbs 95, 99. The oil outflow opening 107 is in this case arranged for example in alignment with the second U limb 99.

Figure 15:
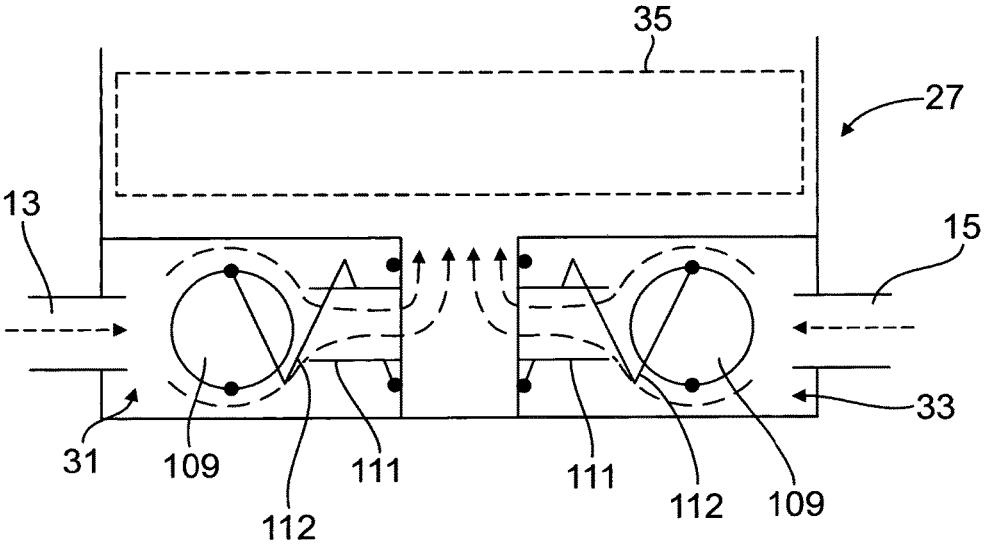
FIGS. 15 and 16 are schematic illustrations depicting the control device.
Figure 16:
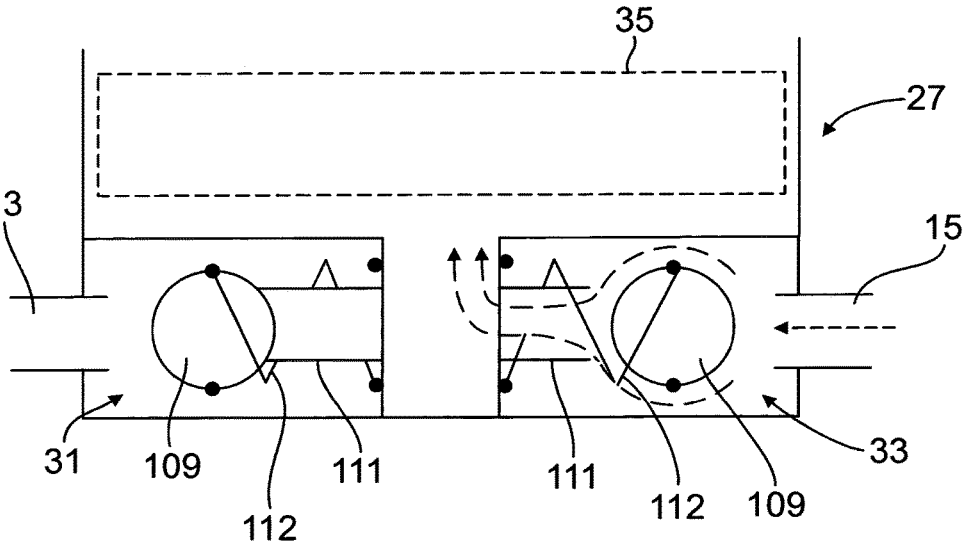

FIGS. 15 and 16 show a third embodiment of the shut-off valve 31, wherein here, by way of example, the entire structural unit 27 of the first embodiment of the apparatus 1 shown in FIG. 1 is illustrated. The shut-off valves 31, 33 are in this case by way of example of structurally identical design. Here, the shut-off valve 31 has a sealing body 109 with a defined flow contour which is pressed against a corresponding sealing seat 111, in order to shut off the fluid flow through the ventilation channel 13, by the fluid flow and which opens up a defined flow cross section in order to enable the fluid flow through the ventilation channel 13.

Here, FIG. 15 shows the shut-off valve 31 in its open position, in which the shut-off valve 31 enables the fluid flow through the ventilation channel 13. FIG. 16 shows the shut-off valve 31 in its closed position, in which the shut-off valve 31 shuts off the fluid flow through the ventilation channel 13. Furthermore, the sealing body 109 is in this case for example of spherical form. Furthermore, a spring element 112 is also provided here, which preloads the sealing body 109 arranged in its closed position into its open position. Furthermore, the oil separator element 35 is in this case formed for example by an active oil separator.

Figure 17:
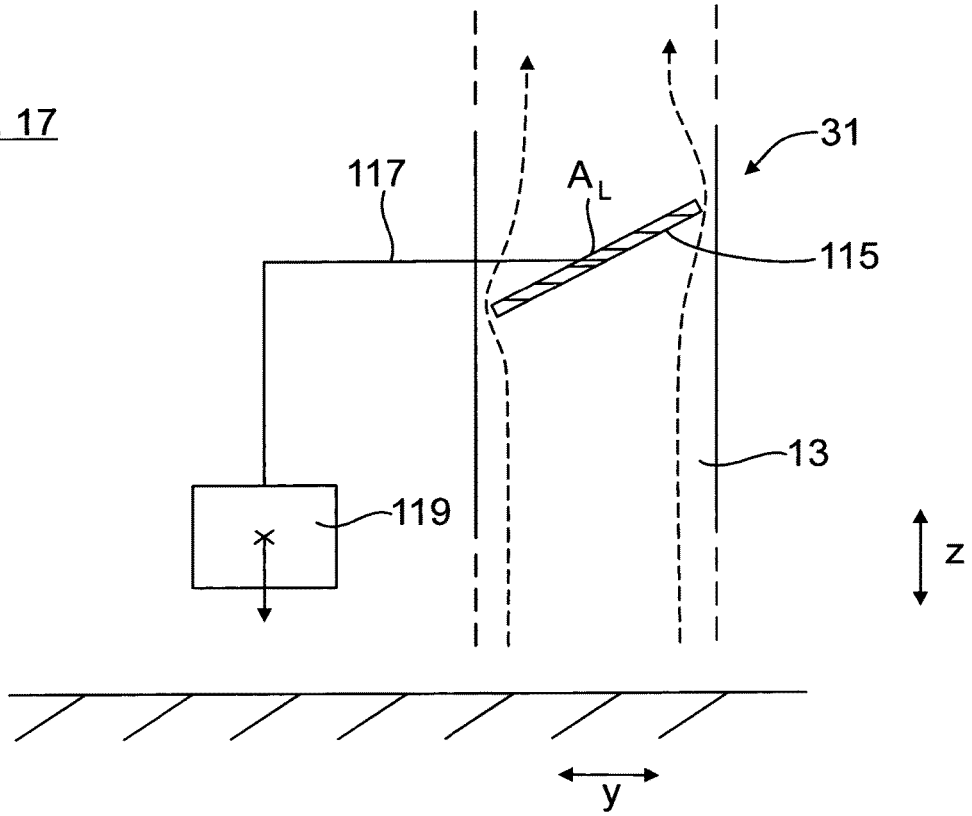
FIGS. 17 and 18 are schematic illustrations depicting the construction of the control device.
Figure 18:
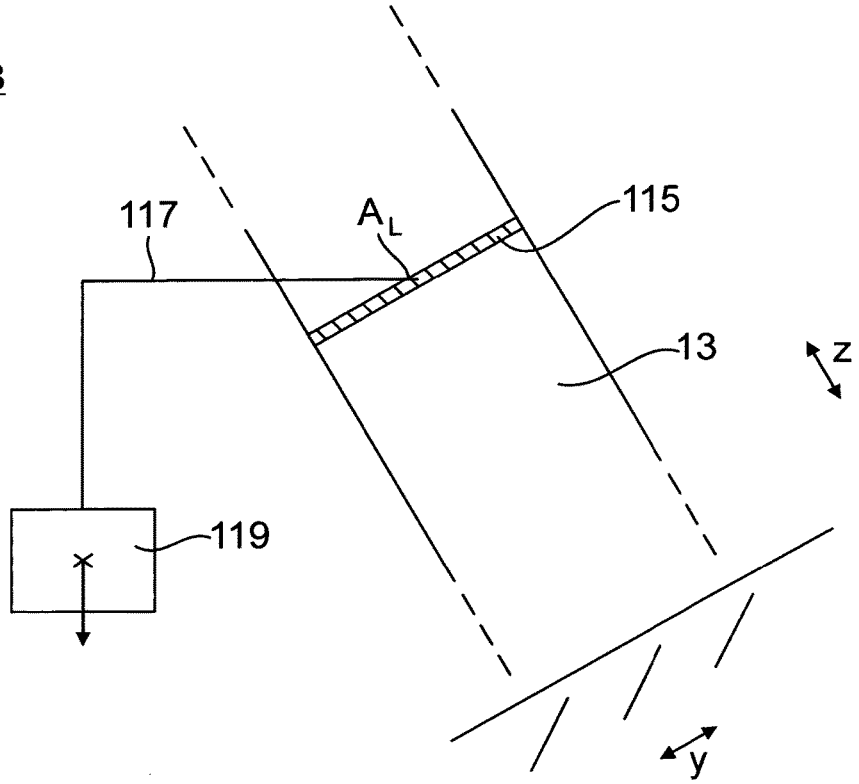

FIGS. 17 and 18 show a fourth embodiment of the shut-off valve 31. Here, the shut-off valve 31 has a shut-off element 115 that is fixed so as to be rotatable relative to the ventilation channel 13 about the longitudinal axis $A_L$ formed by the internal combustion engine longitudinal direction x and which is formed in this case by way of example by a throttle flap. The shut-off element 115 is in this case connected by a lever element 117 to a counterweight element 119 which has a defined mass, such that the shut-off element 115 always has the same orientation relative to the horizontal regardless of the inclination of the internal combustion engine 3 about the longitudinal axis.

Here, FIG. 17 shows the shut-off element 115 in a first rotational position, in which the shut-off element 115 opens up the ventilation channel 13. FIG. 18 shows the shut-off element 115 in a second rotational position, in which the shut-off element 115 shuts off the ventilation channel 13.

While there have been shown, described and pointed out fundamental novel features of the invention as applied to a preferred embodiment thereof, it will be understood that various omissions and substitutions and changes in the form and details of the methods described and the devices illustrated, and in theft operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An apparatus for ventilating a crankcase, comprising:

an internal combustion engine for a vehicle, with multiple ventilation channels by which gases flowing into a crankcase chamber of the crankcase of the internal combustion engine is conducted out of the crankcase chamber;

gas inlet openings, which open into the crankcase chamber and thus into a crank chamber of the internal combustion engine, of the multiple ventilation channels are arranged such that:

in a first defined inclination position of the internal combustion engine, a first ventilation channel does not dip its gas inlet opening into oil sump oil that has collected in an oil sump of the internal combustion engine and a second ventilation channel dips its gas inlet opening into the oil sump oil, and in a second defined inclination position of the internal combustion engine, which differs from the first inclination position, the first ventilation channel dips its gas inlet opening into the oil sump oil and the second ventilation channel does not dip its gas inlet opening into the oil sump oil, a control device by which a fluid flow through the first and second ventilation channels can be shut off and enabled in based at least in part on an inclination of the internal combustion engine, the control device configured such that:

in the first inclination position of the internal combustion engine, the control device opens up the first ventilation channel and shuts off the second ventilation channel, and in the second inclination position of the internal combustion engine, the control device opens up the second ventilation channel and shuts off the first ventilation channel;

a first shut-off valve of the control device is configured to shut off and open up the first ventilation channel;

a second shut-off valve of the control device is configured to shut off and open up the second ventilation channel; and a cylinder head of the internal combustion engine to which the first and/or the second shut-off valve is assigned.

2. The apparatus as claimed in claim 1, further comprising:

at least one oil separator arranged upstream of an intake tract, as viewed in a fluid flow direction, configured to separate oil from fluid flowing via the first and second ventilation channels into the intake tract, wherein in the first inclination position of the internal combustion engine, the control device is configured to shut off a fluid flow through the second ventilation channel to the oil separator, and in the second inclination position of the internal combustion engine, the control device is configured to shut off a fluid flow through the first ventilation channel to the oil separator.

3. The apparatus as claimed in claim 2, wherein:

the first shut-off valve is arranged upstream of the at least one oil separator element, as viewed in the fluid flow direction, and/or the second shut-off valve is arranged upstream of the at least one oil separator element, as viewed in the fluid flow direction.

4. The apparatus as claimed in claim 2, wherein:

the first shut-off valve and at least one oil separator form a structural unit, and/or the second shut-off valve and at least one oil separator form a structural unit, and/or the first shut-off valve, the second shut-off valve and at least one oil separator form a structural unit.

5. The apparatus as claimed in claim 1, further comprising:

an inclination detection device of the control device configured to detect a present inclination of the internal combustion engine, wherein the first and/or the second shut-off valve can be automatically activated by a control unit of the control device based at least in part on a detected present inclination of the internal combustion engine in order to shut off or open up a respective ventilation channel.

6. The apparatus as claimed in claim 1, wherein the first and/or the second shut-off valve is configured as a float valve, wherein a float body of the float valve is a sealing element configured to be pressed against a corresponding sealing seat to shut off the fluid flow through the first or the second ventilation channel and opens up a defined flow cross section to enable the fluid flow through the other of the first or the second ventilation channel.

7. The apparatus as claimed in claim 6, wherein at least one of:

the float valve has at least one loading element, configured as a spring element, which preloads the float body arranged in its closed position into its open position, and the float valve is arranged in a U-limb of a substantially U-shaped ventilation channel section, a U-base of which has at least one base-wall-side oil outflow opening for a discharge of oil that has collected in the U-base and/or in the U-limb.

8. The apparatus as claimed in claim 1, wherein the first and/or the second shut-off valve has at least one sealing body with a defined flow contour that can be pressed against a corresponding sealing seat to shut off fluid flow through the first or the second ventilation channel, by the fluid flow and which opens up a defined flow cross section in order to enable the fluid flow through the other of the first or the second ventilation channel, wherein the at least one sealing body is one of: spherical, plate-shaped, and configured to have a defined flow resistance value.

9. The apparatus as claimed in claim 8, wherein at least one loading element configured as a spring element, is provided, which preloads the sealing body arranged in its closed position into its open position, and/or in that, as viewed in a fluid flow direction, the sealing body is arranged directly upstream of at least one active oil separator.

10. The apparatus as claimed in claim 1, wherein the first and/or the second shut-off valve has a shut-off element which is fixed so as to be rotatable relative to a respective ventilation channel about an axis of rotation and which, in a first rotational position, opens up the respective ventilation channel and, in a second rotational position, shuts off the respective ventilation channel, wherein the shut-off element is connected by at least one lever element to a counterweight element which has a defined mass, such that the shut-off element always has a same orientation relative to a horizontal, regardless of the inclination of the internal combustion engine about an inclination axis running in a direction of the axis of rotation, wherein provision is made for the at least one shut-off element to be formed by a throttle flap and/or a rotary slide.

11. A method for ventilating a crankcase of an internal combustion engine for a vehicle having multiple ventilation channels by which gases flowing into a crankcase chamber of a crankcase of the internal combustion engine are conducted out of the crankcase chamber, comprising:

arranging gas inlet openings, which open into the crankcase chamber and thus into the crankcase chamber of the internal combustion engine, of the multiple ventilation channels such that:

in a first defined inclination position of the internal combustion engine, a first ventilation channel does not dip its gas inlet opening into oil sump oil that has collected in an oil sump of the internal combustion engine and a second ventilation channel dips its gas inlet opening into the oil sump oil, and in a second defined inclination position of the internal combustion engine, which differs from the first inclination position, the first ventilation channel dips its gas inlet opening into the oil sump oil and the second ventilation channel does not dip its gas inlet opening into the oil sump oil, characterized providing a control device by which a fluid flow through the first and second ventilation channels is shut off and enabled in terms of flow in a manner based at least in part on an inclination of the internal combustion engine, wherein in the first inclination position of the internal combustion engine, the control device opens up the first ventilation channel and shuts off the second ventilation channel, and in the second inclination position of the internal combustion engine, the control device opens up the second ventilation channel and shuts off the first ventilation channel, providing a first shut-off valve of the control device configured to shut off and open up the first ventilation channel, providing a second shut-off valve of the control device configured to shut off and open up the second ventilation channel, and assigning the first and/or the second shut-off valve to a cylinder head of the internal combustion engine.

12. A vehicle, having an apparatus as claimed in claim 1 configured to carry out a method as claimed in claim 11.

* * * * *